US006237716B1

(12) United States Patent
Peng

(10) Patent No.: US 6,237,716 B1
(45) Date of Patent: May 29, 2001

(54) STANDARD-SIZED VIBRATING DIAPHRAGM SPEAKER STRUCTURE

(76) Inventor: Jack Peng, P.O. Box No. 6-57, Chung-Ho City, Taipei Hsien 235 (TW)

( * ) Notice: Subject to any disclaimer, the term of this patent is extended or adjusted under 35 U.S.C. 154(b) by 0 days.

(21) Appl. No.: 09/537,489

(22) Filed: Mar. 30, 2000

(51) Int. Cl.[7] ..... G10K 13/00

(52) U.S. Cl. ..... 181/171; 181/169; 181/170; 181/164; 181/173

(58) Field of Search ..... 181/169, 170, 181/171, 164, 173

(56) References Cited

U.S. PATENT DOCUMENTS 3,855,428 * 12/1974 Itagaki ..... 179/115.5 ES
3,862,376 * 1/1975 White ..... 179/115 R
4,234,766 * 11/1980 Cacho ..... 179/115.5 R
4,275,278 * 6/1981 Sakurai et al. ..... 179/181 F
4,440,259 * 4/1984 Strohbeen ..... 181/146
5,072,806 * 12/1991 Odajima ..... 181/170
5,099,949 * 3/1992 Mitobe ..... 181/171
5,162,619 * 11/1992 Thiele et al. ..... 181/166
5,903,658 * 5/1999 Okazaki et al. ..... 381/428

* cited by examiner

*Primary Examiner*—Robert E. Nappi
*Assistant Examiner*—Kim Lockett
(74) *Attorney, Agent, or Firm*—Dougherty & Troxell

(57) ABSTRACT

The invention herein of a standard-sized Vibrating Diaphragm speaker structure, primarily includes a stand with an enlarged opening in the front and a magnetic element in the rear, a cylinder inside a magnetic element, a spring panel sticking with a cylinder, and a Vibrating Diaphragm located on the enlarged opening of the stand. The inner face of Vibrating Diaphragm sticks with cylinder. The improved structure of the invention is characterized as that the surface of Vibrating Diaphragm is free of end fixture and it sticks with a foam washer, which is located at the lower portion of Vibrating Diaphragm and is stuck with an enlarged opening of a stand. Thus, the effective vibration area for a Vibrating Diaphragm is maximized and the output of sound magnitude for a speaker is enhanced. A foam washer substitutes the function of flexible movement for an end fixture of the invention of prior art to achieve normal sound output of a speaker.

1 Claim, 5 Drawing Sheets

STANDARD-SIZED VIBRATING DIAPHRAGM SPEAKER STRUCTURE

BACKGROUND OF THE INVENTION

1) Field of the Invention

The invention is related to an improved speaker, especially, a kind of latest speaker structure, which enlarges the area of Vibrating Diaphragm to nearly the opening size of support frame to achieve maximum output of sound magnitude by designing standard-sized Vibrating Diaphragm speaker structure.

2) Description of the Prior Art

As shown in FIG. 1, the speakers of prior of art include a stand A1, and a Vibrating Diaphragm A2 with end fixture A3, which functionally provides firm central fixture, moreover, it achieves flexible movement for Vibrating Diaphragm A2 with an arch shape design to ensure proper function of the speaker.

However, the output of sound magnitude of a speaker is proportional to the size of Vibrating Diaphragm A2. Due to the constraint of exposed end fixture A3 design, the defectives for the speaker structure of prior of art include that the opening size of stand A1 is approximately equal to total area of Vibrating Diaphragm A2 and end fixture A3. The effective area for Vibrating Diaphragm A2 is smaller than that of the opening size of stand A1, thus the output of sound magnitude is relatively limited.

Due to the above fact, the inventor conducts constant research and study. Finally, the invention is successful after a series of tests and improvement.

SUMMARY OF THE INVENTION

The primary objective of invention is to design a free of end fixture to maximize the size of Vibrating Diaphragm to nearly the opening size of stand A1.

The secondary objective of invention is to provide an inner end fixture for the invention of a new speaker to complement accurate positioning of Vibrating Diaphragm.

To achieve the above objective, the invention herein of a standard-sized Vibrating Diaphragm speaker structure, primarily includes a stand with an enlarged opening in the front and a magnetic element in the rear, a cylinder inside magnetic element, a spring panel sticking with cylinder, and a Vibrating Diaphragm located on the enlarged opening of the stand. The inner face of Vibrating Diaphragm sticks with cylinder. The improved invention is characterized as that the surface of Vibrating Diaphragm is free of end fixture and it sticks with a foam washer, which is located at the lower portion of Vibrating Diaphragm and is stuck with an enlarged opening of a stand. Thus, the effective vibration area for a Vibrating Diaphragm is maximized to nearly the size of opening of a stand and the output of sound magnitude for a speaker is enhanced. A foam washer substitutes the function of flexible movement for an end fixture of the invention of prior art to achieve normal sound output of a speaker.

The followings are brief description for optimal embodiments of the invention for committee's better understanding in the structural assembly and operations of the invention.

DETAILED DESCRIPTION OF THE PREFERRED EMBODIMENT

Figure 1:
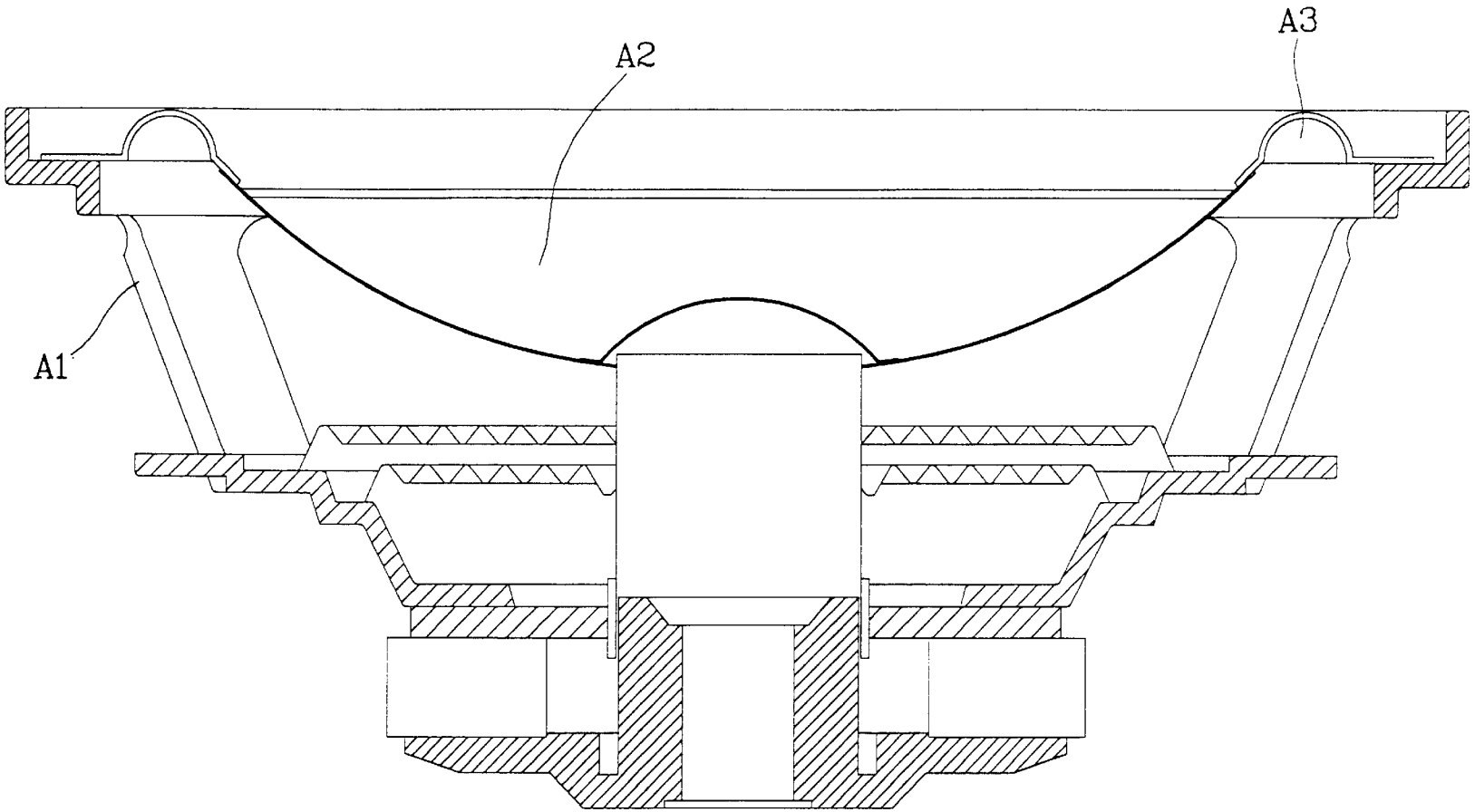
Fig.1 Prior Art
FIG. 1 is a drawing for a speaker embodiment of the invention of prior art.
Figure 2:
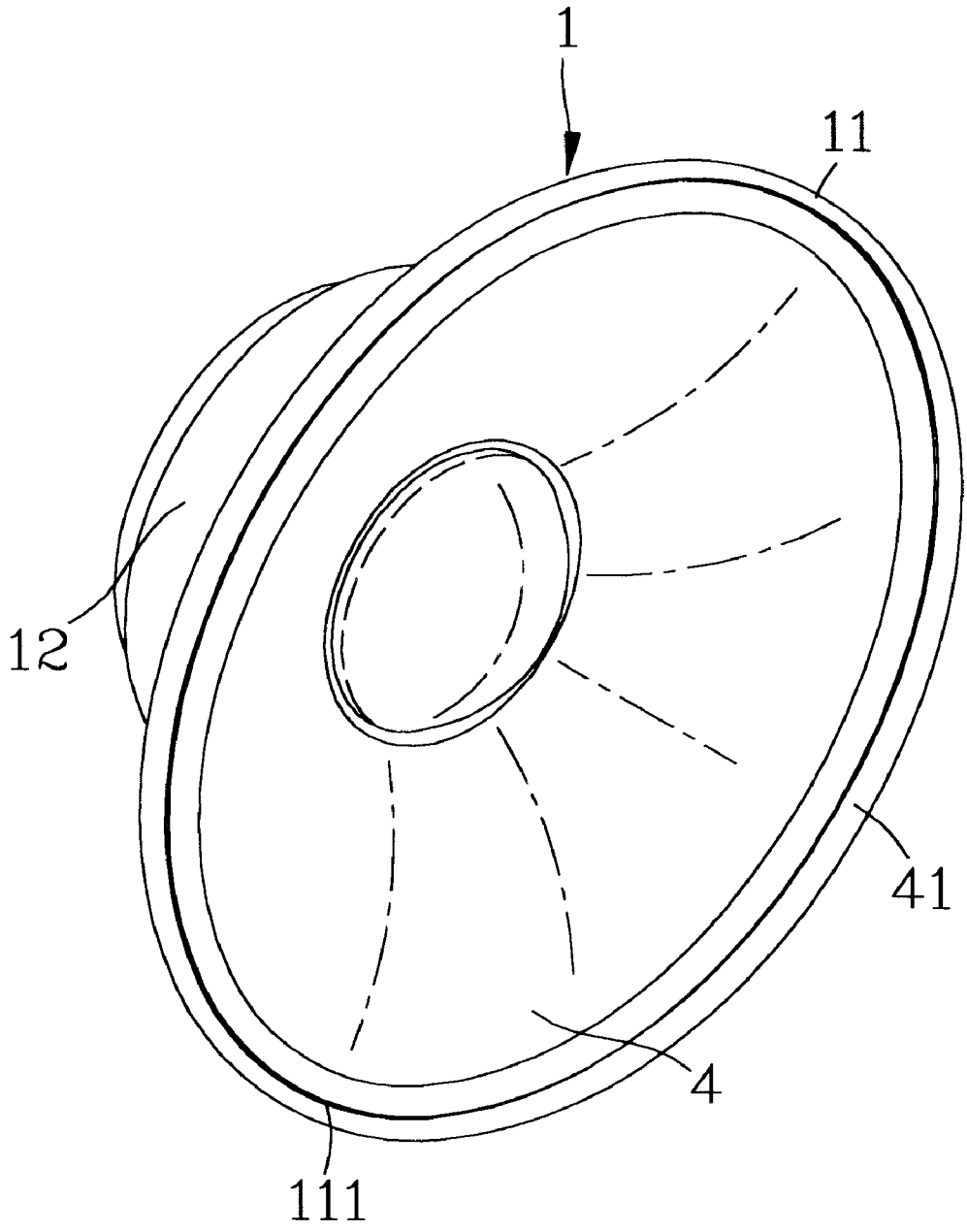
FIG. 2 is an isometric drawing of the invention.
Figure 3:
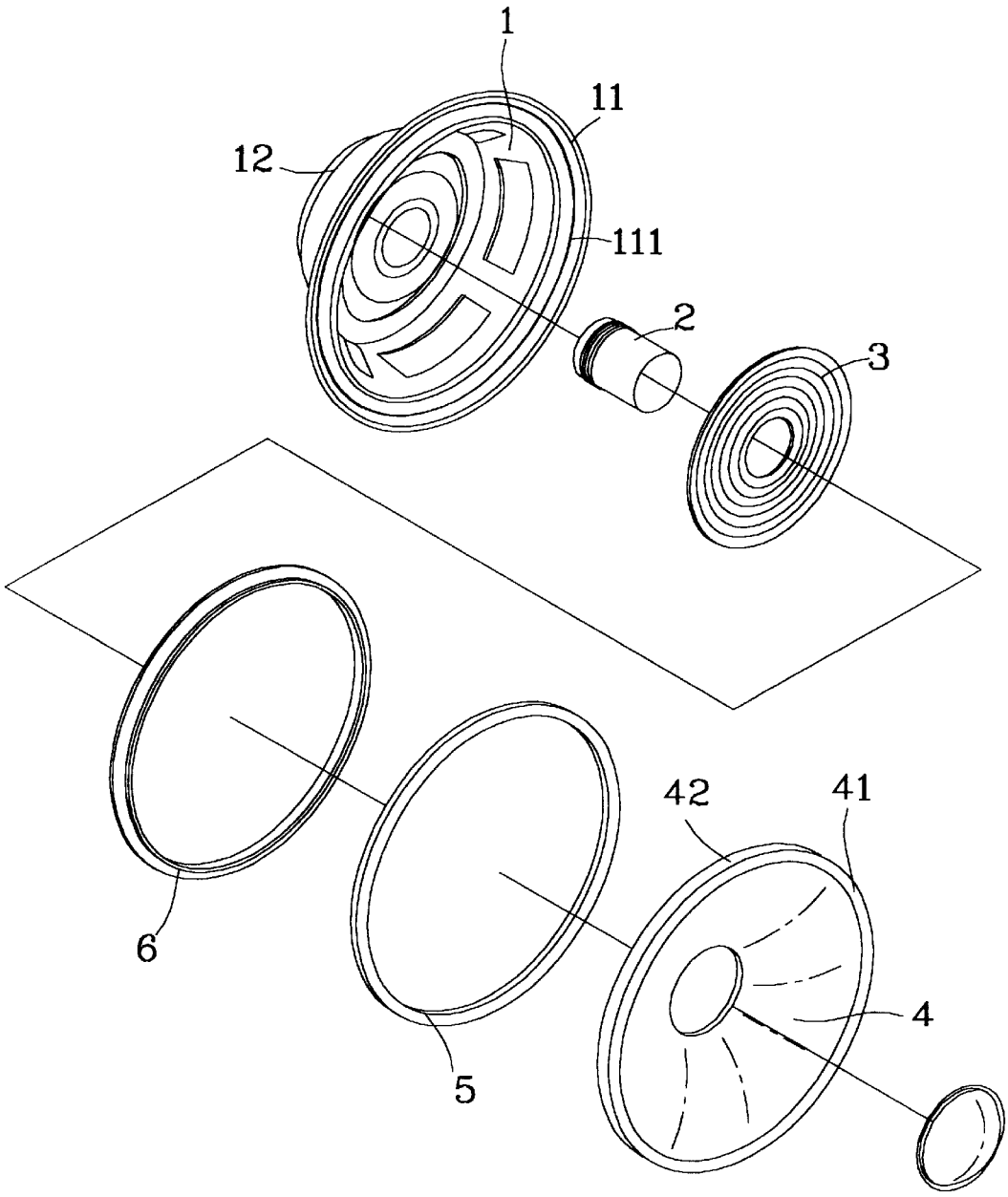
FIG. 3 is an isometric drawing of an embodiment of the invention.

As shown in FIG. 2 and FIG. 3, the invention of a standard-sized Vibrating Diaphragm speaker structure mainly includes stand 1, cylinder 2, spring panel 3, Vibrating Diaphragm 4, and a foam washer 5. Stand 1 is equipped with an enlarged opening in the front and magnetic element 12 in the rear. Cylinder 2 is located within the middle of magnetic element 12. Spring panel 3 sticks with cylinder 2. Vibrating Diaphragm 4 is located on an enlarged opening 11 of a stand. The inner face of Vibrating Diaphragm sticks with cylinder and the surface of Vibrating Diaphragm 4 is free of end fixture. The main improvement is characterized as foam washer 5 located at the lower portion of Vibrating Diaphragm 4 and is stuck with enlarged opening 11 of a stand.

Thus, with the design of foam washer 5, effective vibration area for Vibrating Diaphragm 4 is maximized to nearly the size of opening 11 of a stand and the output of sound magnitude for a speaker is enhanced without changing the size of a speaker. Also, through the flexibility of foam washer 5, the function of flexible movement for an end fixture of the invention of prior art is substituted to achieve normal sound output of a speaker.

Figure 4:
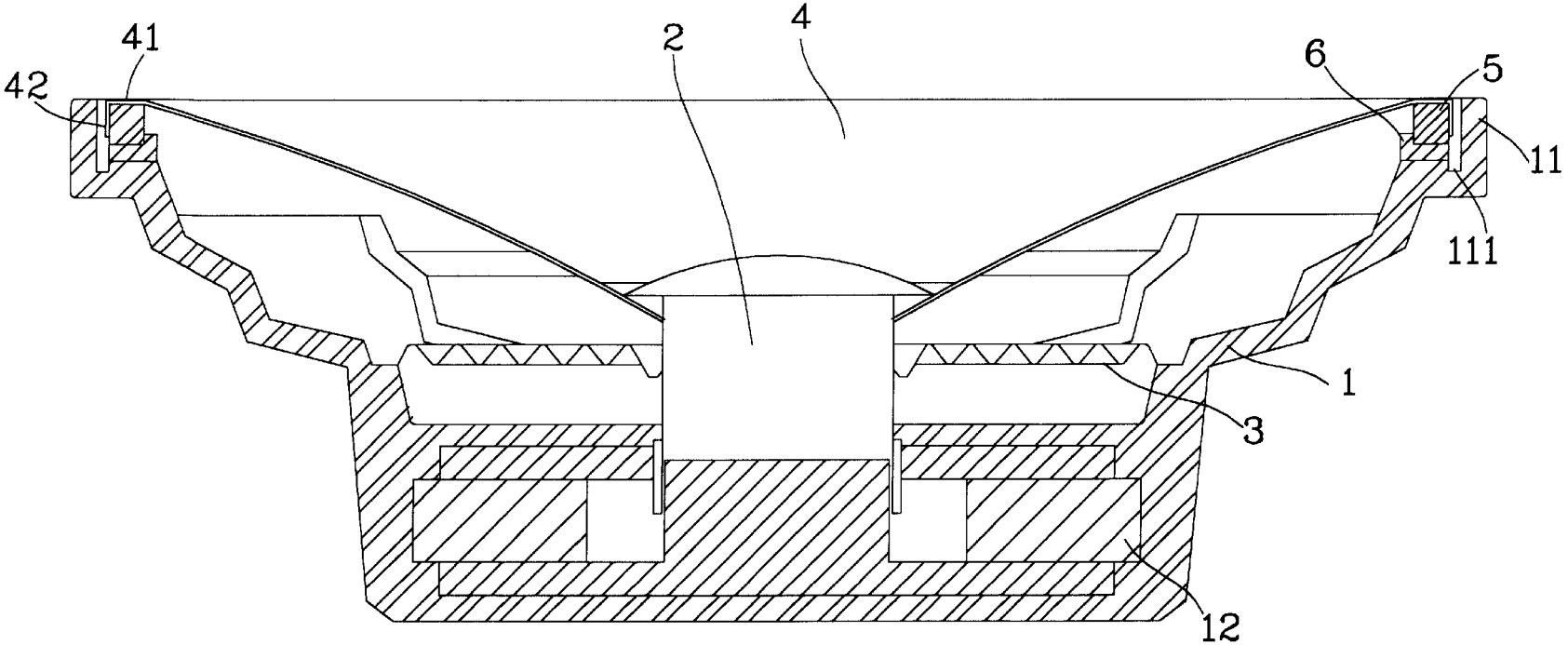
FIG. 4 is a drawing for a speaker embodiment of the invention.

Please refer to FIG. 4 of an embodiment of the invention. The profile of enlarged opening 11 of stand 1 is in L shape with greater exterior height and less interior height. At the interface with diversified heights, there is a concave groove 111. Vibrating Diaphragm 4 is in a bowl shape with a flat circular face 41 and folded end edge 42. Positioning washer 6 is seated between foam washer 5 and stand 1. The profile of positioning washer 6 is in counter L shape with greater interior height and less exterior height to comply with flat circular face 41 and folded end edge and to optimize the positioning effect of foam washer 5 at installation.

Figure 5:
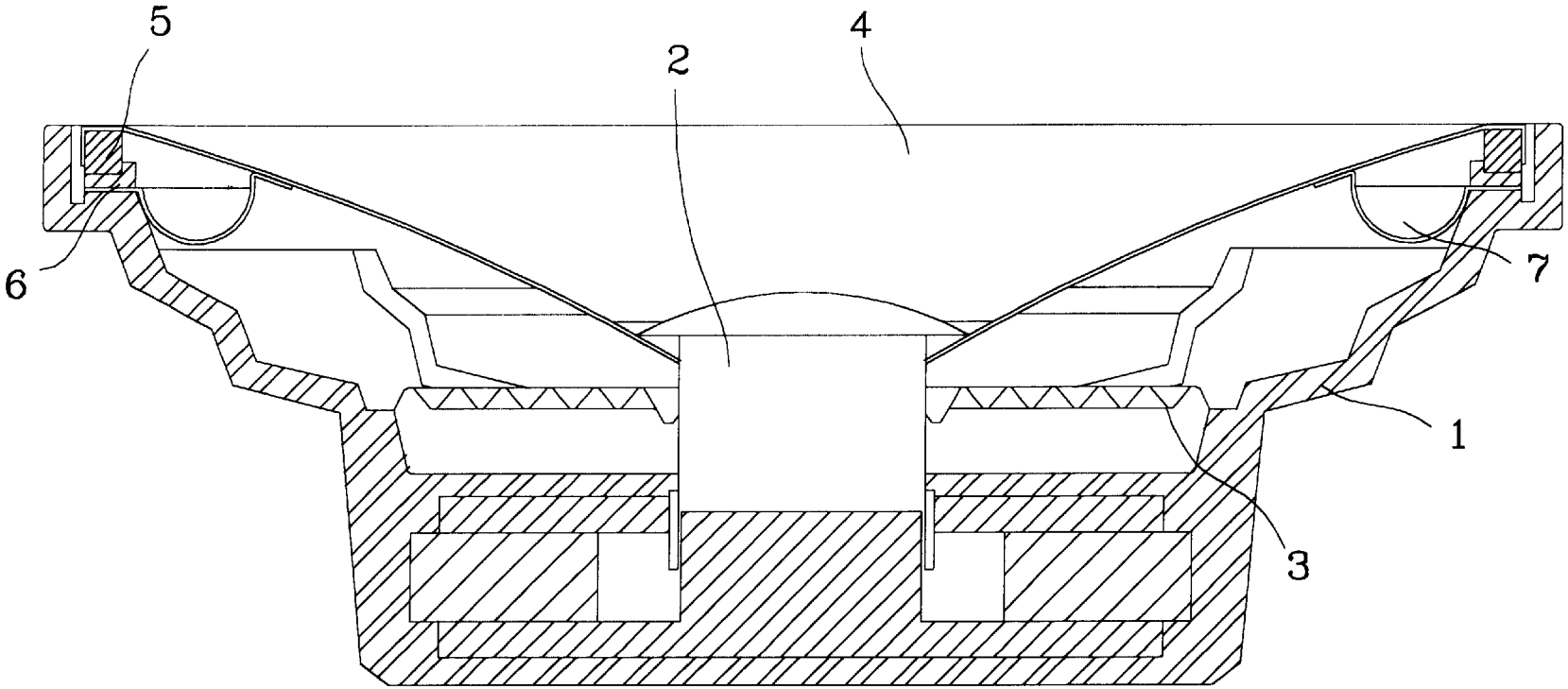
FIG. 5 is a drawing of an embodiment of the invention in an open state.

Besides, please refer to FIG. 5, the invention equips a concealed arch end fixture 7 connecting the lateral portion of Vibrating Diaphragm 4 and stand 1 to assist central positioning of Vibrating Diaphragm 4.

The above explanation is a substantial embodiment of the invention, which provides greater practical performance than products of prior art. Furthermore, the present invention meets all new patent application requirements and is lawfully submitted for review and the granting of the commensurate patent rights to thereby encourage the spirit of invention and its rightful protection under the patent law.

What is claimed is:

1. A vibrating diaphragm speaker comprising:

a) a stand having a magnetic element mounted therein, a spring panel attached thereto, and a cylinder attached to the spring panel and located within a middle of the magnetic element, the stand having a rim portion extending around an enlarged opening, the rim portion having an L-shaped profile with a groove therein;

b) a vibrating diaphragm having a bowl shape with an inner portion attached to the cylinder and an outer portion comprising a flat circular face with a folded edge;

c) a foam washer attached to a side of the flat, circular face facing toward the rim portion of the stand; and, d) a positioning washer attached to the foam washer and the rim portion such that the folded edge of the vibrating diaphragm is spaced from the rim portion.

* * * * *